US008938915B2

(12) United States Patent
Jones et al.

(10) Patent No.: US 8,938,915 B2
(45) Date of Patent: Jan. 27, 2015

(54) DOOR JAMB REINFORCER

(71) Applicants: Isaac Jones, Phenix City, AL (US); Johnathon K. Jones, Panama City Beach, FL (US)

(72) Inventors: Isaac Jones, Phenix City, AL (US); Johnathon K. Jones, Panama City Beach, FL (US)

( * ) Notice: Subject to any disclaimer, the term of this patent is extended or adjusted under 35 U.S.C. 154(b) by 0 days.

(21) Appl. No.: 13/763,611

(22) Filed: Feb. 8, 2013

(65) Prior Publication Data

US 2014/0223831 A1 Aug. 14, 2014

(51) Int. Cl.
*E05B 1/00* (2006.01)
*E06B 1/52* (2006.01)

(52) U.S. Cl.
CPC ..... *E06B 1/52* (2013.01)
USPC ..... 49/460; 292/346

(58) Field of Classification Search
USPC ..... 49/460; 292/340, 346
See application file for complete search history.

(56) References Cited

U.S. PATENT DOCUMENTS

| | | | | | |
|---|---|---|---|---|---|
| 1,323,755 | A * | 12/1919 | Gogay | 49/504 |
| 4,858,384 | A * | 8/1989 | Blankenship | 49/460 |
| 5,070,650 | A * | 12/1991 | Anderson | 49/460 |
| 5,566,509 | A * | 10/1996 | Long | 49/462 |
| D375,446 | S * | 11/1996 | Nelson | D8/343 |
| 6,176,527 | B1 * | 1/2001 | Bench | 292/340 |
| 7,866,113 | B2 * | 1/2011 | Young | 52/656.4 |
| 7,946,635 | B2 * | 5/2011 | Canerdy, Jr. | 292/340 |
| 8,132,832 | B2 * | 3/2012 | Anderson | 292/340 |
| 2005/0011132 | A1 * | 1/2005 | Griffin | 49/460 |
| 2008/0224486 | A1 * | 9/2008 | Anderson | 292/340 |
| 2008/0284182 | A1 * | 11/2008 | Canerdy, Jr. | 292/346 |
| 2012/0181801 | A1 * | 7/2012 | Willis et al. | 292/338 |

* cited by examiner

*Primary Examiner* — Jerry Redman
(74) *Attorney, Agent, or Firm* — Jones IP Law, LLC; Dennis W. Jones

(57) ABSTRACT

A door jamb reinforcer that provides for reinforcement of the door jamb and the frame of an entry way door to prevent forced entry is disclosed. The door jamb reinforcer includes a latchbolt opening, a deadbolt opening, and a plurality of fastener openings, and is secured to the door jamb via long fasteners extending through corresponding fastener openings and into the door frame behind the door jamb.

15 Claims, 5 Drawing Sheets

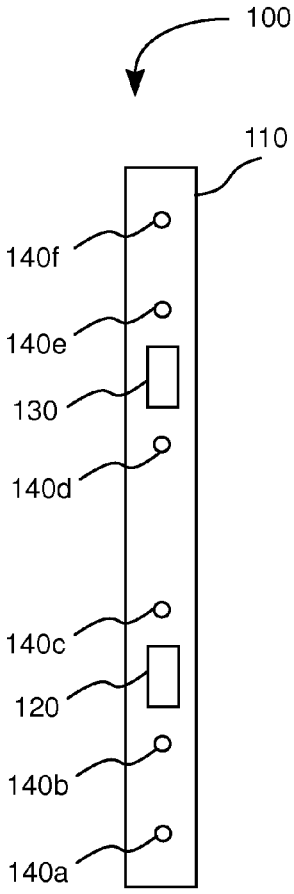
Fig. 2-A
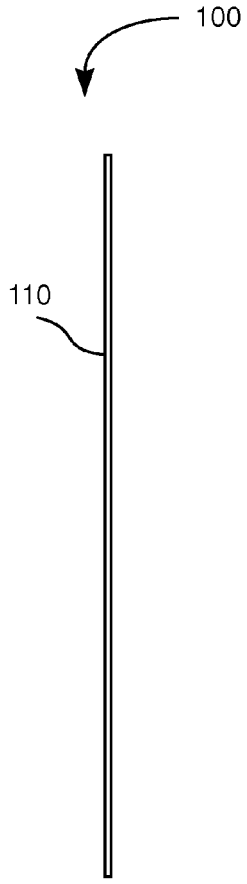
Fig. 2-B
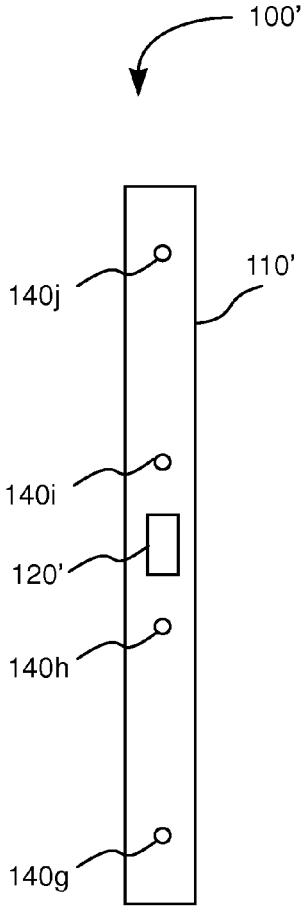
Fig. 3

DOOR JAMB REINFORCER

BACKGROUND

1. Field of Invention

This invention pertains generally to entry way door security. More particularly, this invention pertains to providing improved strength and reinforcement to door jambs for prevention of forced entry through an entry way door.

2. Description of the Related Art

Residential security is an important part of owning or renting a home. Security for business, worship, and other non-profit entities is also essential. The entry way doors of many premises are equipped with standard type door locks, deadbolts and latches, which are effective against routine entry and other law abiding citizenry. However, typical latches and deadbolts are inherently weak and provide little security against a determined entrant with the willingness and strength to kick in the entry way door.

FBI statistics report that a large majority of break-ins occur via forced entry through the front door of a dwelling or other structure. A typical deadbolt often extends only to the door jamb while a typical strike plate includes only two woodscrews that are so short as to rarely extend even through the door jamb. Even extending the length of the two woodscrews of a typical strike plate provides little additional security.

As such, there is a need in the market for a door security device that provides additional reinforcement of the door jamb of an entry way door.

BRIEF SUMMARY

According to one embodiment of the present invention, a door jamb reinforcer that provides for reinforcement of the door jamb and the frame of an entry way door to prevent forced entry is disclosed. The door jamb reinforcer includes a latchbolt opening and a deadbolt opening and is secured to the door jamb via fasteners, such as long wood screws, extending through corresponding fastener openings and into the door frame behind the door jamb.

According to one embodiment a door jamb reinforcer for reinforcing a door jamb of a door frame in an entry way door includes an elongated bar having a length and a width and a thickness, and including a first opening, a second opening, and a plurality of fastener openings, the first opening and second opening respectively spaced substantially equidistant from opposite ends of the elongated bar, and spaced a distance apart corresponding to approximately one-third of the length. The first opening is sufficiently sized for receiving a latchbolt. The second opening is sufficiently sized for receiving a deadbolt. A plurality of fasteners having sufficient length for extending through the door jamb and into the door frame correspond to a plurality of fastener openings sufficiently sized for the respective fasteners. The fasteners are affixed through the corresponding fastener openings to extend through the door jamb into the wood frame to provide added strength to the door jamb and prevent forced entry through the entry way door.

In another embodiment, a door jamb reinforcer for reinforcing a door jamb of a door frame in an entry way door includes an elongated bar having a length and a width and a thickness, and including a first opening and a plurality of fastener openings, the first opening substantially centered lengthwise between opposite ends of the elongated bar. The first opening is sized for receiving a bolt from a door. A plurality of fasteners having sufficient length for extending through the door jamb and into the door frame correspond to a plurality of fastener openings sized for the respective fasteners. The fasteners are affixed through the corresponding fastener openings to extend through the door jamb into the wood frame to provide added strength to the door jamb and prevent forced entry through the entry way door.

In yet another embodiment, the door jamb reinforcer is installed via aligning the latchbolt opening and the deadbolt opening of the door jamb reinforcer with the corresponding latchbolt hole and deadbolt hole in the door jamb. A pilot hole is drilled into the door jamb for each corresponding screw opening in the plate. Fasteners of sufficient length to extend through the door jamb, the first frame stud, and into the second frame stud are drilled through the screw opening and into the corresponding pilot hole. The fasteners are installed for each fastener opening to provide the maximum effective reinforcement of the door jamb.

Other systems, methods, features and advantages of the present invention will be or become apparent to one with skill in the art upon examination of the following drawings and detailed description. It is intended that all such additional systems, methods, features and advantages be included within this description and be within the scope of the present disclosure.

BRIEF DESCRIPTION OF THE DRAWINGS

The above-mentioned features will become more clearly understood from the following detailed description read together with the drawings in which:

FIG. 2-A is a front view of the door jamb reinforcer of FIG. 1;

FIG. 2-B is a side view of the door jamb reinforcer of FIG. 1;

FIG. 3 is a front view of an alternative embodiment of a door jamb reinforce;

DETAILED DESCRIPTION

A door jamb reinforcer that provides improved support and reinforcement of the door jamb and the frame of an entry way door to prevent forced entry is disclosed. In one typical configuration, the door jamb reinforcer includes a metal plate having openings for a latchbolt and a deadbolt affixed to a door jamb via fasteners, such as long wood screws, extending into the door frame.

Figure 1:
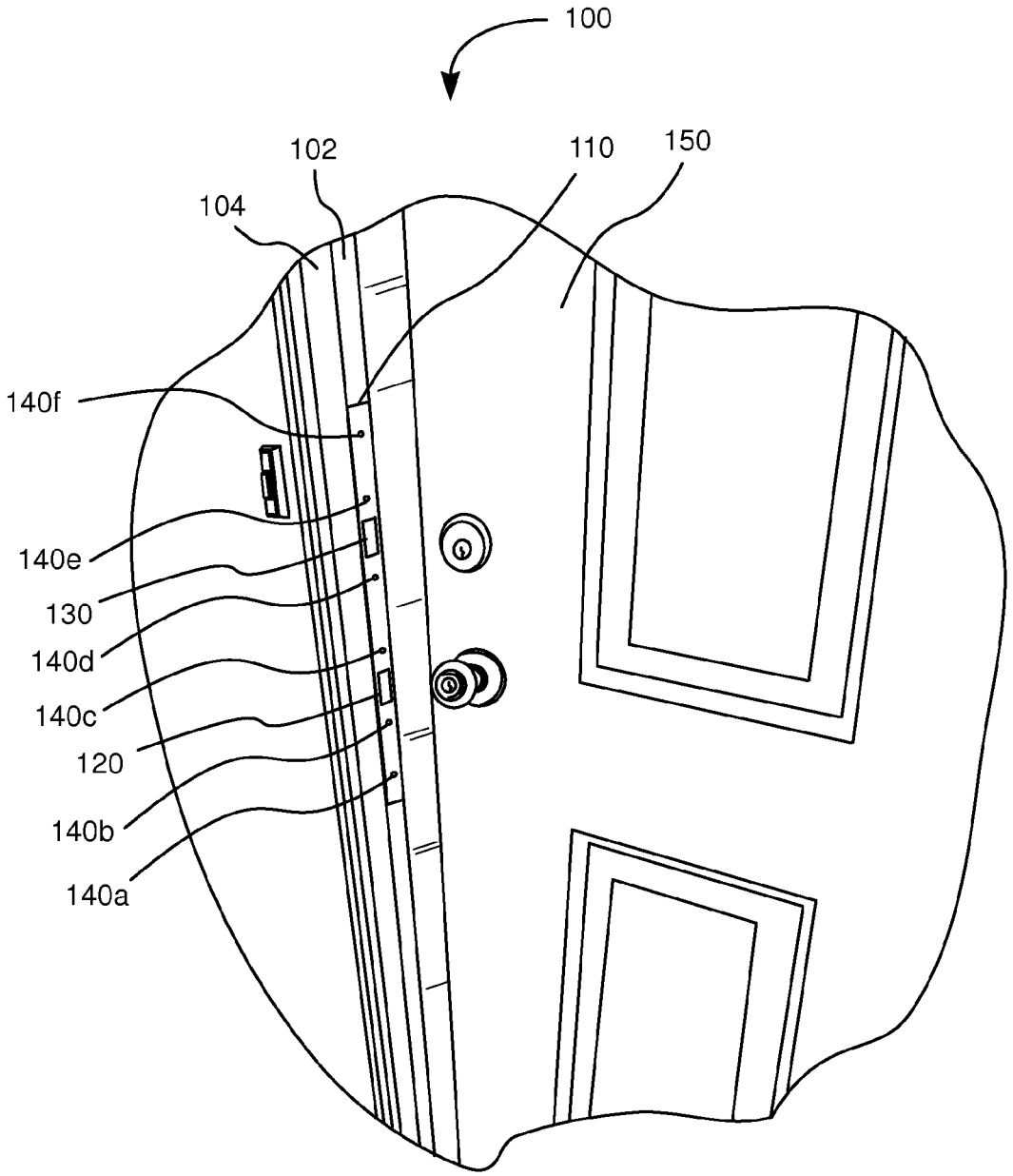
FIG. 1 is a perspective view of a door jamb reinforcer installed in the door jamb of an entry way door.

FIG. 1 is a perspective view of a door jamb reinforcer 100 installed in the door jamb 102 of an entry way door 150. In the illustrated embodiment, the door jamb reinforcer 100 includes an plate 110 (or jamb bar) secured to a door jamb 102 and adjacent to a door stop 104. In a typical door 150, the door stop 104 is affixed lengthwise approximately midway between edges of the door jamb 102 to prevent the door 150 from swinging past the center of the entry way. The plate 110 includes a latchbolt opening 120, a deadbolt opening 130, and multiple fastener openings 140.

In one embodiment, when secured to the door jamb 102, the plate 110 receives a door latchbolt at the latchbolt opening 120 to latch the door 150 in the closed position Likewise, the plate 110 receives a deadbolt at the deadbolt opening 130 to secure the door 150 in the closed and locked position.

FIG. 2-A is a front view of the door jamb reinforcer 100 and FIG. 2-B is a side view of the door jamb reinforcer 100. The door jamb reinforcer 100 includes a plate 110, a latchbolt opening 120, a deadbolt opening 130, and a plurality of fastener openings 140*a*, 140*b*, 140*c*, 140*d*, 140*e*, 140*f* (collectively fastener openings 140). In the illustrated embodiment, the door jamb reinforcer 100 includes both a latchbolt opening 120 and a deadbolt opening 130 for receiving a latchbolt and a deadbolt respectively to secure the door 150. Alternative embodiments may include multiple latchbolt openings 120 and/or deadbolt openings 130 for providing additional security.

In the illustrated embodiment, the plate 110 includes six fastener openings 140*a*, 140*b*, 140*c*, 140*d*, 140*e*, 140*f* (fastener openings 140). The fastener openings 140 provide for securing the plate 100 to the door jamb 102 via fasteners, such as wood screws for example, of sufficient length to extend through the door jamb 102 and into a frame to which a door jamb 102 is attached. Securing the plate 110 to a door frame is discussed in further detail below. The fastener openings 140 are spaced with an opening proximate either end of the plate 110, and adjacent either end of the latchbolt opening 120 and the deadbolt opening 130 respectively.

Those of skill in the art will readily appreciate that the total number of fastener openings 140 may vary according to a specific door jamb reinforcer 100 embodiment and also according to the length of the particular plate 110 used in the installation.

In one embodiment, the plate 110 of the door jamb reinforcer 100 is an elongated plate and is approximately 18 inches in length, 1-¾ inches in width, and ⅛ inches in thickness. Those of skill in the art will readily appreciate that dimensions may vary according to the desired strength and reinforcement for the door jamb 102. The plate 110 is long enough to provide for multiple fasteners sufficiently spaced along the length of the plate 110 to secure the plate 110 and the door jamb 102 to the frame. In one embodiment, the distance between the inner edge of the latchbolt opening 120 and the inner edge of the deadbolt opening 130 is approximately one-third the length of the plate 110. In such an embodiment, the distance between the inner edge of the latchbolt opening 120 and the respective near end of the plate 110 is approximately equal to the distance between the inner edge of the deadbolt opening 130 and the respective near end of the plate 110. When properly installed, the fasteners extend into the frame behind the door jamb 102 and provide reinforcement proportional to the number and length of the fasteners and to the spacing of the fasteners along the plate 110. In such embodiments, the installed door jamb reinforcer 100 provides sufficient reinforcement to the door jamb 102 that it is very difficult for a person of typical strength to kick in a door 150 and to compromise the entry way.

In one embodiment, the width of the plate 110 generally corresponds substantially to the width between the edge of the door stop 104 and the inside edge of the door jamb 102. The thickness of the plate 110 is such that the plate 110 fits snugly between the door jamb 102 and the edge of a closed door 150. In such a configuration, the door jamb reinforcer 100 provides for additional security against forced entry via a would-be intruder inserting devices such as credit cards, files, and the like, between the door 150 and the door jamb 102.

In one embodiment, the plate 110 is constructed from metal, such as a metal plate for example, having sufficient strength to provide increased strength and reinforcement to the door jamb 102 and frame combination when installed with wood screws of sufficient length to extend into the frame. Those of skill in the art will readily appreciate that many materials will provide sufficient strength to extend the strength of the plate 110 when constructed with suitable dimensions.

FIG. 3 is a front view of an alternative embodiment of a door jamb reinforcer 100'. The door jamb reinforcer 100' includes a plate 110', a latchbolt opening 120' and a plurality of fastener openings 140*g*, 140*h*, 140*i*, 140*j*. In the illustrated embodiment, the door jamb reinforcer 100' includes a latchbolt opening 120' and four fastener openings 140*g*, 140*h*, 140*i*, 140*j*.

The fastener openings 140*g*, 140*h*, 140*i*, 140*j* provide for securing the plate 110 to the door jamb 102 via fasteners of sufficient length to extend through the door jamb 102 and into a frame to which a door jamb 102 is attached. The fastener openings 140*g*, 140*h*, 140*i*, 140*j* are spaced with an opening proximate either end of the plate 110, and adjacent either end of the latchbolt opening 120.

In one such alternative embodiment, the length the plate 110' of the door jamb reinforcer 100' is approximately 12 inches in length, 1-¾ inches in width, and ⅛ inches in thickness. Those of skill in the art will readily appreciate that dimensions may vary according to the desired strength and reinforcement for the door jamb 102. The plate 110' is long enough to provide for multiple fasteners sufficiently spaced along the length of the plate 110' to secure the plate 110' and the door jamb 102 to the frame.

Figure 4:
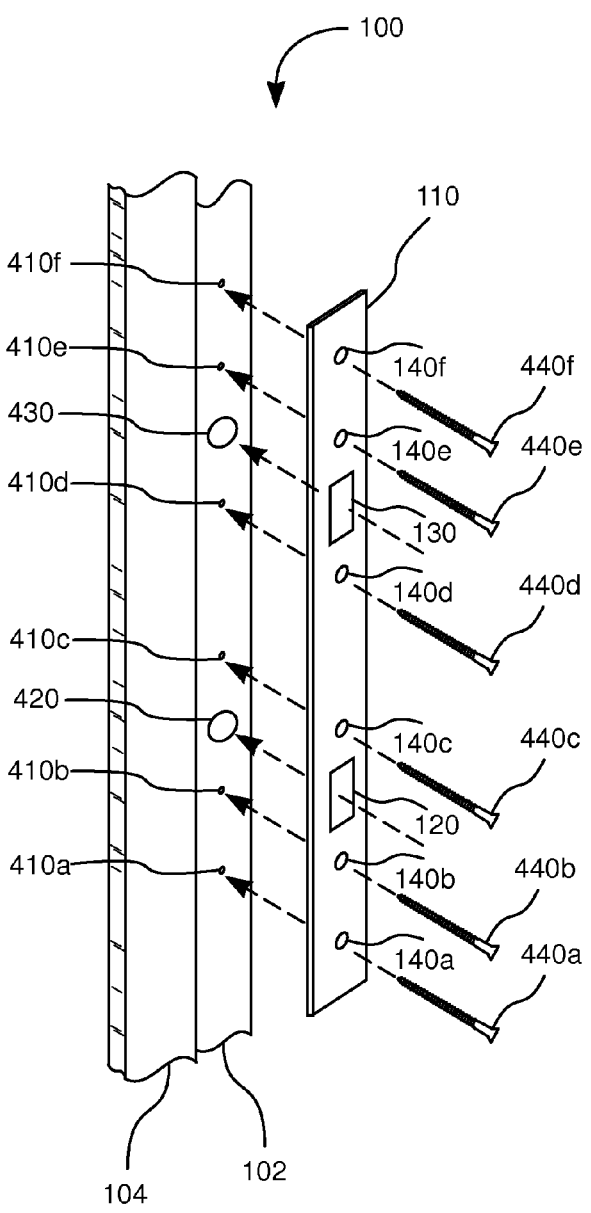
FIG. 4 is an exploded perspective view of the door jamb reinforcer with a door jamb of an entry way.
Figure 5:
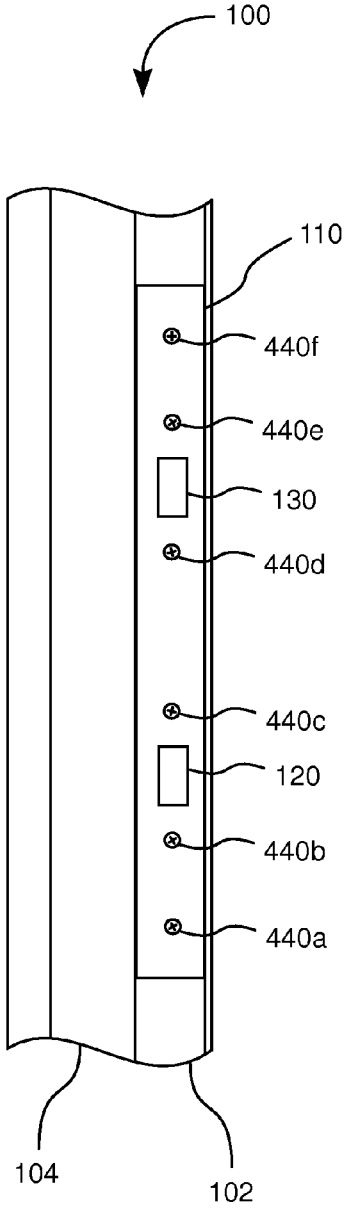
FIG. 5 is a front view of a door jamb reinforcer installed on a door jamb.

FIG. 4 is an exploded perspective view of the door jamb reinforcer 100 with a door jamb 102 of an entry way and FIG. 5 is a front view of a door jamb reinforcer 100 installed on a door jamb 102. In the illustrated embodiment, six fasteners 440*a*, 440*b*, 440*c*, 440*d*, 440*e*, 440*f* (collectively fasteners 440) are inserted respectively through the six fastener openings 140*a*, 140*b*, 140*c*, 140*d*, 140*e*, 140*f* and into the door jamb 102 to secure the plate 110 to the door jamb 102. In the illustrated embodiment, pilot holes 410*a*, 410*b*, 410*c*, 410*d*, 410*e*, 410*f* (collectively pilot holes 410) are drilled into the door jamb 102. Further, in the illustrated embodiment, the fasteners 440 are wood screws. For the remainder of this document, the term fasteners 440 is used interchangeably with wood screws 440 for illustrative purposes. Those of skill in the art will readily appreciate that various other type fasteners 440 such as various type bolts, nails, and such like may be used as fasteners 440. The pilot holes 410*a*, 410*b*, 410*c*, 410*d*, 410*e*, 410*f* provide increased ease of drilling wood screws 440*a*, 440*b*, 440*c*, 440*d*, 440*e*, 440*f* through the door jamb 102 and into the frame.

Those of skill in the art will readily appreciate that the total number of fastener openings 140, pilot holes 410, and fasteners 440 may vary according to a specific embodiment of the door jamb reinforcer 100 and also according to the length of the particular plate 110 in the door jamb reinforcer 100.

Again, those of skill in the art will also readily appreciate that there are other fasteners 440 in addition to wood screws that may be substituted to secure the door jamb reinforcer 100 to the door jamb 102. Such fasteners include but are not limited to various type bolts, nails, and any other such fastener 440 which may suitable dig into and stay reasonably anchored into the door frame.

It should be noted also that the door jamb 102 includes a latchbolt hole 420 corresponding to the latchbolt opening 120 of the plate 110 and a deadbolt hole 430 corresponding to the deadbolt opening 130 of the plate 110. The latchbolt hole 420 and the deadbolt hole 430 provide sufficient depth for the respective latchbolt and deadbolt to fully extend when activated.

It should be further noted that the door jamb reinforcer 100 is installed to the door jamb 102 and adjacent the door stop 104.

Figure 6:
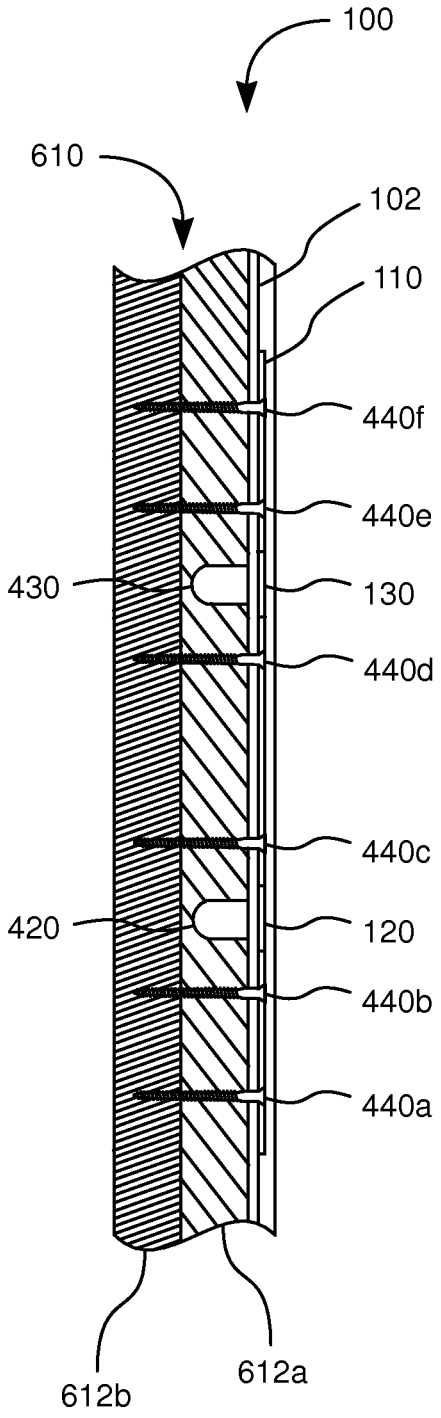
FIG. 6 is a cutaway side view of a door jamb reinforcer secured to a door frame through a door jamb.

FIG. 6 is a cutaway side view of a door jamb reinforcer 100 secured to a door frame 610*a*, 610*b* through a door jamb 102. The door jamb reinforcer 100 is shown with a door frame 610 and both the door jamb reinforcer 100 and the door frame 610 in cutaway view. In the illustrated embodiment, the door frame 610 includes two frame studs 612*a*, 612*b*

In the illustrated embodiment, six wood screws 440*a*, 440*b*, 440*c*, 440*d*, 440*e*, 440*f* (collectively wood screws 440) extend through the plate 110, and also through the door jamb 102, and into the frame 610 to secure the door jamb reinforcer 100 in place against the door jamb 102. Those of skill in the art will readily appreciate that the total number of wood screws 440 may vary according to a specific embodiment of the door jamb reinforcer 100 and also according to the length of the particular plate 110 in the door jamb reinforcer 100.

Door frames 610 often include a pair of frame studs 612*a*, 612*b* to which the door jambs 102 are secured on either side of the door 150 entry way. Typical frames are built from 2×4 studs. It is well known in the industry that 2×4 studs typically have actual dimensions of 1-½ inches by 3-½ inches. In such a door 150 entry way, the wood screws 440 extend through the door jamb 102, through one frame stud 612*a* and into a second frame stud 612*b*.

In one embodiment, the length of the wood screws 440 exceeds the combined depth of the door jamb reinforcer 100, the door jamb 102, the first frame stud 612*a*, and part of the second frame stud 612*b*. In such an embodiment, a typical wood screw 440 has a length of 4-½ inches or greater. It should be noted that other length wood screws 440 may be appropriate depending on the installation, the length of the plate 110, and the size and/or number of frame studs in the door frame 610. When installed as in the illustrated embodiment, the door jamb reinforcer 100 provides sufficient reinforcement to the door jamb 102 that it is very difficult for a person of typical strength to kick in a door 150 and to compromise the entry way.

Figure 7:
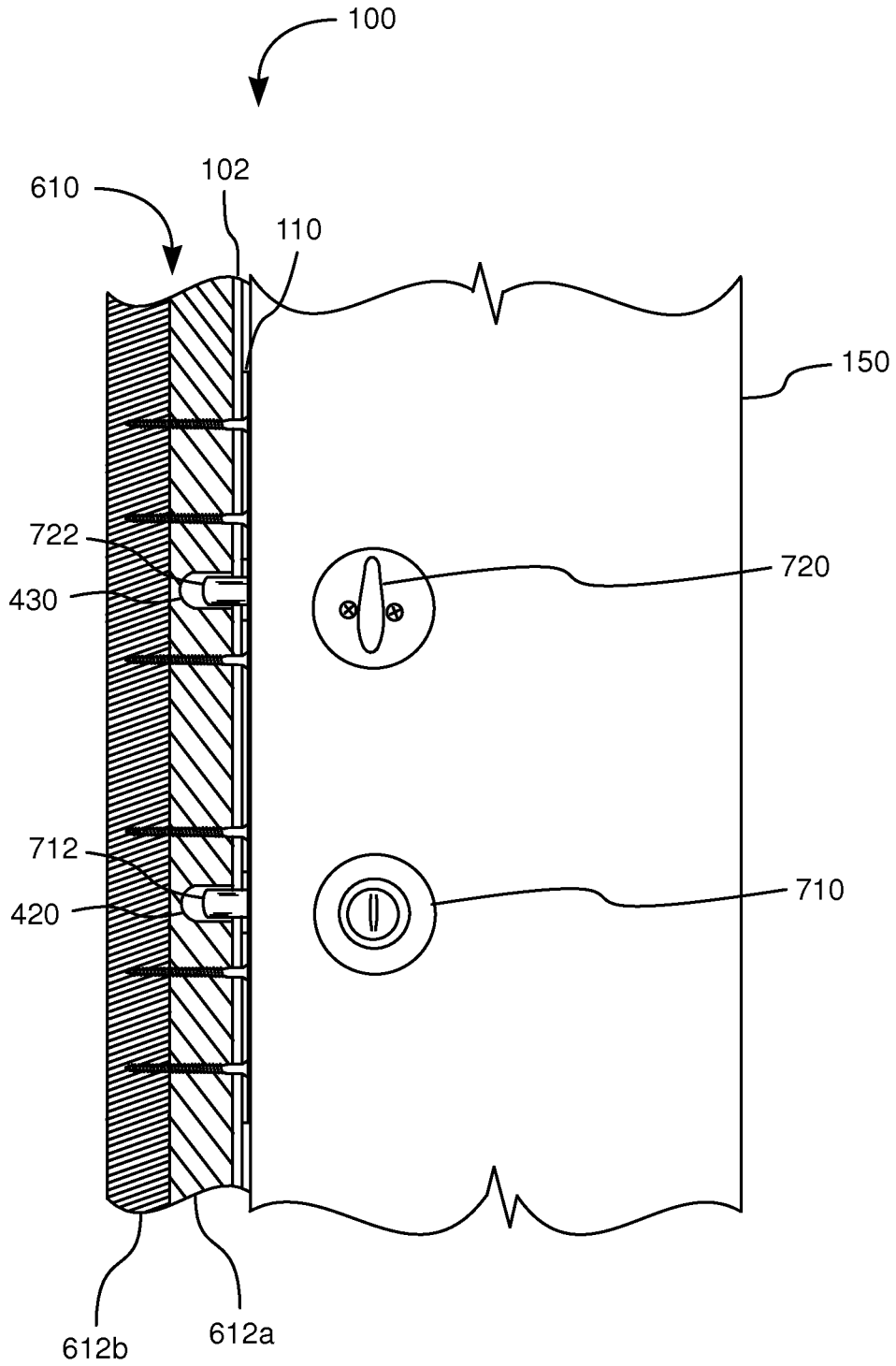
FIG. 7 is an internal view of a closed door and illustrating the operation of a latchbolt and a deadbolt with an installed door jamb reinforcer shown in cutaway view.

FIG. 7 is an internal view of a closed door 150 and illustrating the operation of a latchbolt 712 and a deadbolt 722 with an installed door jamb reinforcer 100 shown in cutaway view. The door 150 includes a door knob 710 and a deadbolt twist knob 720. The door knob 710 includes a mechanism for operating the latchbolt 712 for releasing the latchbolt to open the door 150 and for securing the latchbolt to maintain the door 150 in a closed position. The deadbolt twist knob 720 operates to activate or release the deadbolt 722 and provides for additional security of the door 150 in a closed position.

When activated, the latchbolt 712 extends through the plate 110 of the door jamb reinforcer 100 and into the latchbolt hole 420. Similarly, when activated, the deadbolt 722 extends through the plate 110 of the door jamb reinforcer 100 and into the deadbolt hole 430.

In the illustrated embodiment, the door jamb reinforcer 100 is secured to the door jamb via wood screws 400 that penetrate through the door jamb 102, through a first frame stud 610*a*, and into a second frame stud 610*b*. The length of the wood screws 440 and the spacing of the wood screws 440 along the length of the plate 110 of the door jamb reinforcer 100 provide for significant reinforcement to the strength of the door jamb 102 and of the latchbolt 712 and the deadbolt 722. As noted above, the door jamb reinforcer 100 provides sufficient reinforcement to the door jamb 102 that it is very difficult for a person of typical strength to kick in a door 150 and to compromise the entry way.

For installation, the latchbolt opening 120 and the deadbolt opening 130 of the door jamb reinforcer 100 are aligned with the corresponding latchbolt hole 420 and deadbolt hole 430 in the door jamb 102. A pilot hole 410 is drilled into the door jamb 102 for each corresponding screw opening 140 in the plate 110. Wood screws 440 of sufficient length to extend through the door jamb 102, the first frame stud 612*a*, and into the second frame stud 612*b* are drilled through the screw opening 140 and into the corresponding pilot hole 410. In a preferred embodiment, wood screws 440 should be installed for each screw opening 140 to provide the maximum effective reinforcement of the door jamb 102.

From the foregoing description, it will be recognized by those skilled in the art that a door jamb reinforcer 100 that provides for reinforcement of the door jamb 102 and the frame 610 of an entry way door 150 to prevent forced entry is disclosed. In one embodiment, the door jamb reinforcer 100 includes a latchbolt opening 120 and a deadbolt opening 130 and is secured to the door jamb 102 via long wood screws 440 extending through corresponding fastener openings 140 and into the door frame 610 behind the door jamb 102.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art.

The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A door jamb reinforcement system for an entry way door, the door jamb reinforcement system consisting of:

a door frame having a door jamb sized for the entry way door, said door jamb including a door stop, and further including at least two openings on an inner portion of the door jamb adjacent the door stop, the at least two openings situated for receiving a latchbolt and a deadbolt;

a single elongated plate, said single elongated plate having a flat rectangular shape with a length and a width and a thickness, and including a first opening, a second opening, and a plurality of fastener openings, said first opening and said second opening respectively spaced substantially equidistant from opposite ends of said elongated plate, and spaced a distance apart corresponding to approximately one-third of said length;

said width sized to correspond to the inner portion of the door jamb so that the elongated plate abuts the door stop on one side, and said width further sized so that the elongated plate covers the width of the inner portion of the door jamb;

said thickness of said single elongated plate sized to match space between the door jamb and an edge of a closed door;

said first opening sufficiently sized for receiving the latchbolt;

said second opening sufficiently sized for receiving the deadbolt;

a plurality of fasteners having sufficient length for extending through the door jamb and into the door frame; and said plurality of fastener openings corresponding to said plurality of fasteners, each fastener opening sufficiently sized for receiving said respective fastener;

said elongated plate affixed to said door jamb via said fasteners extending through said fastener openings, and further extending through the door jamb into the door frame, to provide added strength to the door jamb and prevent forced entry through the entry way door.

2. The door jamb reinforcer of claim 1, further comprising said single elongated plate made of metal.

3. The door jamb reinforcer of claim 1, further comprising said fastener openings comprising six fastener openings wherein two of said fastener openings are located with one near each end of said elongated plate, wherein two of said fastener openings are located near either end of said first opening, and wherein two of said fastener openings are located near either end of said second opening.

4. The door jamb reinforcer of claim 1, wherein said length is approximately 18 inches, said width is approximately 1-¾ inches, and said thickness is approximately ⅛ inch.

5. The door jamb reinforcer of claim 1, said fasteners further comprising at least 3 inches length.

6. The door jamb reinforcer of claim 1, said fasteners further comprising at least 3-½ inches length.

7. A door jamb reinforcement system for an entry way door, the door jamb reinforcement system consisting of:

a door frame having a door jamb sized for the entry way door, said door jamb including a door stop, and further including at least one opening on an inner portion of the door jamb adjacent the door stop, the at least one opening situated for receiving a bolt fastener from a door;

a single elongated bar, said single elongated bar having a flat rectangular shape with a length and a width and a thickness, and including a first opening and a plurality of fastener openings, said first opening substantially centered lengthwise between opposite ends of said elongated bar;

said width sized to correspond to the inner portion of the door jamb so that the elongated plate abuts the door stop on one side, and said width further sized so that the elongated plate covers the width of the inner portion of the door jamb;

said thickness of said single elongated bar sized to match space between the door jamb and an edge of a closed door;

said first opening sufficiently sized for receiving the bolt from a door;

a plurality of fasteners having sufficient length for extending through the door jamb and into the door frame; and said plurality of fastener openings corresponding to each fastener, each fastener opening sufficiently sized for receiving said respective fastener;

said elongated bar affixed to said door jamb via said fasteners extending through said fastener openings, and further extending through said door jamb into the door frame to provide added strength to the door jamb and prevent forced entry through the entry way door.

8. The door jamb reinforcer of claim 7, further comprising said single elongated bar made of metal.

9. The door jamb reinforcer of claim 7, wherein said bolt is a latchbolt.

10. The door jamb reinforcer of claim 7, wherein said bolt is a deadbolt.

11. The door jamb reinforcer of claim 7, further comprising said fastener openings including four fastener openings, two of said fastener openings located one each near each end of said elongated bar, and two of said fastener openings located one each near either end of said first opening.

12. The door jamb reinforcer of claim 7, wherein said length is at least 12 inches, said width is approximately 1-¾ inches, and said thickness is approximately ⅛ inch.

13. The door jamb reinforcer of claim 7, further comprising at least one additional opening sized for receiving a deadbolt.

14. The door jamb reinforcer of claim 7, said fasteners further comprising at least 3 inches length.

15. The door jamb reinforcer of claim 7, said fasteners further comprising at least 3-½ inches length.

* * * * *